US005486216A

United States Patent [19]

Shigeno et al.

[11] Patent Number: 5,486,216

[45] Date of Patent: Jan. 23, 1996

[54] COKE HAVING ITS PORE SURFACES COATED WITH CARBON AND METHOD OF COATING

[75] Inventors: Yoshihito Shigeno, Wakabayashi, Japan; James W. Evans, Alameda County, Calif.

[73] Assignee: The Regents of the University of California, Oakland, Calif.

[21] Appl. No.: 370,215

[22] Filed: Jan. 6, 1995

Related U.S. Application Data

[63] Continuation of Ser. No. 228,723, Apr. 18, 1994, abandoned, which is a continuation of Ser. No. 893,505, Jun. 4, 1992, abandoned.

[51] Int. Cl.[6] ..... C10L 5/32

[52] U.S. Cl. ..... 44/591; 44/607

[58] Field of Search ..... 44/591, 607

[56] References Cited

U.S. PATENT DOCUMENTS

| | | | |
|---|---|---|---|
| 2,842,431 | 7/1958 | Robertson | 44/591 |
| 3,711,318 | 1/1973 | Trechock et al. | 44/591 |
| 3,725,018 | 4/1973 | Joseph | 44/591 |
| 3,725,019 | 4/1973 | Zanpirri et al. | 44/591 |
| 3,728,229 | 4/1973 | Reerink et al. | 44/591 |

*Primary Examiner*—Jacqueline V. Howard
*Attorney, Agent, or Firm*—Flehr, Hohbach, Test, Albritton & Herbert

[57] ABSTRACT

A method of upgrading characteristics of coke by forming a carbon coating on the pores of the coke by hydrocarbon cracking. A coke having its pores coated with a layer of carbon.

10 Claims, 6 Drawing Sheets

COKE HAVING ITS PORE SURFACES COATED WITH CARBON AND METHOD OF COATING

This is a continuation of application Ser. No. 08/228,723, filed Apr. 18, 1994 now abandoned, which is a continuation of Ser. No. 07/893,505 filed Jun. 4, 1992, now abandoned.

BRIEF DESCRIPTION OF THE INVENTION

This invention relates generally to coke having the surface of its pores coated with a carbon layer and method of coating the pores by hydrocarbon cracking to increase the coke's oxidation resistance and/or its strength following partial oxidation.

BACKGROUND OF THE INVENTION

In the blast furnace for iron making, coke has the role of providing bed permeability to gas as well as serving as a reducing agent and energy source. Therefore, the coke must have the strength to sustain the weight of the burden. However, coke strength is decreased by the reaction $C+CO_2=2CO$. This reaction is unavoidable because it produces CO which reduces $Fe_2O_3$ and $Fe_3O_4$. However, it results in degrading coke due to oxidation. This degradation leads to coke powdering and this powdered coke hinders the passage of gas through the burden. This is the most undesirable situation for the operation of the blast furnace.

The traditional method of avoiding this problem has been to use high grade coke resistant to oxidation by $CO_2$. However, coal convertible to high grade coke is far less available than ordinary coal and is expected to be exhausted in the future.

Coke is made from coal in inefficient "coke ovens" which tend to cause air pollution. Because of the three requirements that coke serves as a reducing agent, a fuel supply and as a support, only a fraction of the world's coals make suitable coke and the difficulties in turning them into coke results in coke being a relatively expensive ingredient in making iron (and subsequently, steel). Stringent requirements are imposed with respect to the reactivity of coke and its resistance to degradation in the high temperature oxidizing environments encountered in blast furnaces.

M. Ogawa, M. Miyawaki and T. Tuyuguchi, 113th ISIJ (Iron & Steel Institute Japan) meeting of April, 1987, Lecture No. S-62, discuss the modification of coke to increase the resistance to oxidation with carbon dioxide. Road tar was heated and dropped on coke heated in the furnace. Thermally cracked carbon was deposited within the coke. Deposition of the thermally cracked carbon was found to improve the reactivity (decrease in oxidation rate) and thereby increase the coke's strength. This method is considered to be effective to improve low-rank coke. However, industrial applications appear to have been precluded by the generation of dust during the cracking process.

U.S. Pat. Nos. 3,725,018 and 3,725,019 describe a method of coating the exterior surface of low-grade coke with a film of glanz carbon. The coating minimizes dusting by providing a hard, dense surface which fills pores adjacent to the surface. The coating is formed from hydrocarbon cracking in the presence of a catalyst.

The oxidation of the coke with $CO_2$ mainly occurs in the lower part of the shaft of the blast furnace where the temperature is 1173°–1773° K. In this temperature region, oxidation occurs on the internal pore surface. The small pores (30 nm<r<0.3 μm) participate in oxidation to a greater extent due to their larger (by one hundred times or more) surface area compared to that of large pores (r>10 μm).

OBJECTS AND SUMMARY OF THE INVENTION

It is an object of this invention to provide a method of improving the oxidation resistance of existing metallurgical cokes and the upgrading of low-grade cokes so that they achieve the properties of metallurgical cokes.

It is another object of this invention to provide an improved coke.

It is yet another object of this invention to provide a method of achieving said improvements which can be easily and efficiently carried out.

The foregoing and other objects of the invention are achieved by decomposing a hydrocarbon gas in the interstices of the coke to form a carbon deposit which substantially uniformly coats all of the pore surfaces, large and small, substantially closing the entrances of the smaller pores. This provides a coke which is characterized by having larger and smaller pores coated with substantially the same thickness of carbon, thereby substantially decreasing the surface area of the smaller pores as compared to the larger pores.

BRIEF DESCRIPTION OF THE DRAWINGS

The foregoing and other objects of this invention will be more clearly understood from the following description when read in conjunction with the accompanying drawings, wherein.

DESCRIPTION OF PREFERRED EMBODIMENT

This invention is directed to an improved coke and to a method of improving its strength and to reduce its oxidation by $CO_2$. In accordance with this invention, pores within the coke are infiltrated by a hydrocarbon gas, such as methane, natural gas, propane, butane, benzene, acetylene, etc., and the hydrocarbon gas in combusted or cracked to produce a carbon deposit, or film, on the surface of the pores. This impregnates and substantially closes the entrances of the small pores (about 30 nm<pore radius<about 0.3 μm) in which considerable oxidation takes place. This carbon deposit or coating substantially prevents $CO_2$ from intruding into these pores, reducing the overall oxidation rate of the coke.

The formation of carbon by thermal decomposition (cracking) of methane proceeds via a variety of intermediate reaction products of hydrocarbons as $CH_4(g)=C(s)+2H_2(g)$. This carbon is expected to infiltrate the pores within coke, thereby preventing $CO_2$ from gaining access to these pores during subsequent exposure to $CO_2$. In our experiments, the simple mathematical model of Straten, et al. (Philips Tech. Rev. 1982, Vol 40, pp 204–210) was used to select experimental conditions (temperature, sample size, and methane partial pressure) likely to yield a uniform carbon deposit in each pore. In a pore, the axial gas distribution is obtained by solving the following equation with suitable boundary conditions (B.C.).

$$D\frac{d^2C}{dz^2}=\frac{2kC}{r} \quad (1)$$

B.C. at z=0, C=Cb
at z=L/2, dC/dz=0

The local thickness of the deposition layer, d(z/r), normalized by its value at the pore mouth, is expressed as $$\frac{d(z/r)}{d(0)}=\frac{\cosh(2z/L-1)\beta}{\cosh\beta} \quad (2)$$

where $\beta=(L/2r)\sqrt{2K}$ and K=kr/D

The present concern is with gas diffusion in the small pore when Knudsen diffusion prevails. The Knudsen diffusion coefficient is given as $$D_k=(2r/3)\sqrt{8RT/DM} \quad (3)$$

The reaction rate constant is estimated by use of the experimental result of Delvin, et al., Proc. #11th Int. Conf. on CVD, The Electrochemical Society 1990 pp 499–505.

$$k=4.75\times10^{12}\times\exp(-4.38\times10^4/T) \quad (4)$$

From Eqs. (3) and (4), K is estimated and tabulated in Table I at representative temperatures.

TABLE 1

| T (K) | K (–) |
|---|---|
| 973 | $1.8\times10^{-10}$ |
| 1073 | $1.1\times10^{-8}$ |
| 1173 | $3.5\times10^{-7}$ |
| 1273 | $6.3\times10^{-6}$ |
| 1373 | $7.5\times10^{-5}$ |

Figure 1:
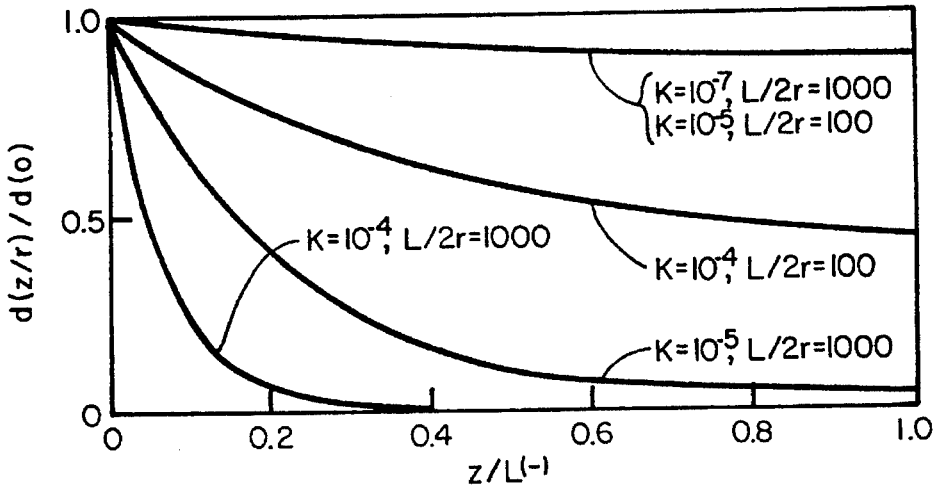
FIG. 1 shows the estimated growth of thickness of deposited carbon layer along an axis of a single cylindrical pore.

The calculated deposited layer distribution through eq. (2) and by use of K is shown in FIG. 1, where the lines are determined by two parameters. K and pore length to diameter ratio (L/2r). The figure implies that the distribution tends to be axially homogeneous, the lower the temperature and the shorter the relative pore length. Additionally, it is found that there is no effect of methane partial pressure on the homogeneity. As the value in Table I and the result in FIG. 1 imply that the homogeneous layer forms at temperatures under 1073° K., even when the relative pore length is unrealistically large. However, preliminary experiments showed that at temperatures under 1173° K. for coke, the reaction rate was too slow to conduct infiltration and coating with carbon to an adequate extent within several hours. Therefore, in our experiments, infiltration of coke was conducted at approximately 1273° K.

To understand the reduction of oxidation by $CO_2$, it is observed that the overall oxidation reaction occurring on the pore wall is $C(s)+CO_2(g)=2CO(g)$. Using a mathematical model, Tien, et al. (Carbon, 1970 Vol 8, pp 607–621) examined the rate-controlling step for a metallurgical coke oxidation as a function of sample size, temperature and total and partial pressures. According to their result, the oxidation of the present study should be under chemical step control. Therefore, the progress of oxidation of samples could be simply compared without evaluating the outer surface area of an irregular geometry of coke. However, it should be noted that "chemical step control" means $CO_2$ distributes itself through the sample homogeneously in a macroscopic sense. In micro pores (r<1 nm) diffusion of $CO_2$ is retarded, i.e., there is a concentration gradient of gases. Therefore, pores greater than 30 nm oxidize preferentially although the surface area of a micro pore (r<1 nm) is larger by more than 100 times. If the temperature is reduced, allowing gas diffusion into the micro pores, oxidation actually proceeds in these pores.

Figure 2:
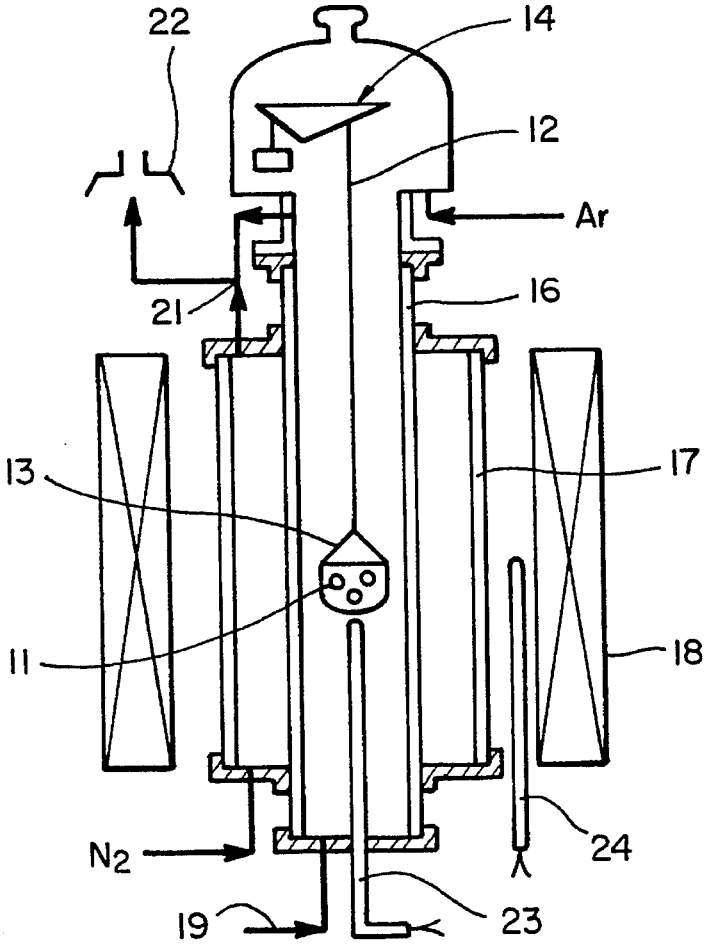
FIG. 2 is a schematic diagram of an experimental apparatus.

The apparatus used in our experimental studies is shown in FIG. 2. The sample 11 was suspended in the homogeneous temperature zone (±5 K.) of the furnace with a stainless steel wire 12, which suspended a stainless steel basket 13 from microbalance 14. Several grains of coke 11 were set in the stainless steel basket. The infiltration and oxidation rates were determined by continuously monitoring the weight.

The reaction tube 16 (40 mm in inner diameter) was surrounded by another larger coaxial tube 17 (57 mm in inner diameter). They were made of transparent fused silica. Between the outer and inner tube, cooling gas ($N_2$) flowed at $6.7\times10^{-5}$ $m^{-3}s^{-1}$ (4 $lmin^{-1}$) to keep the inner tube cool and prevent carbon depositing on the inner surface of the reaction tube. The sample was heated by radiation from the electric furnace 18.

The reaction gas for infiltration was a mixture of methane and argon introduced at the bottom 19 of the reaction tube. The flow rate of the gas mixture was about 5–8.3×$10^{-6}m^{-3}s^{-1}$ (0.3–0.5 $lmin^{-1}$). The unreacted gas and cooling gas were merged at 21 to dilute the methane to below the flammable limit for venting into the air through a hood 22. A continuous argon purge protected the balance chamber from unwanted deposition.

The temperature was measured by a thermocouple 23 inserted just underneath the sample. The temperature of the furnace was controlled by a second thermocouple 24 set outside the reaction tube adjacent to the heating element.

Oxidation testing followed the infiltration experiment with changes in only a few experimental conditions: the reaction gas was a mixture of Ar and $CO_2$ (10%), the gas flow rate was $5\times10^{-5}m^{-3}s^{-1}$ (3 $lmin^{-1}$), temperature was 1223° K. and no cooling gas was used.

Figure 3:
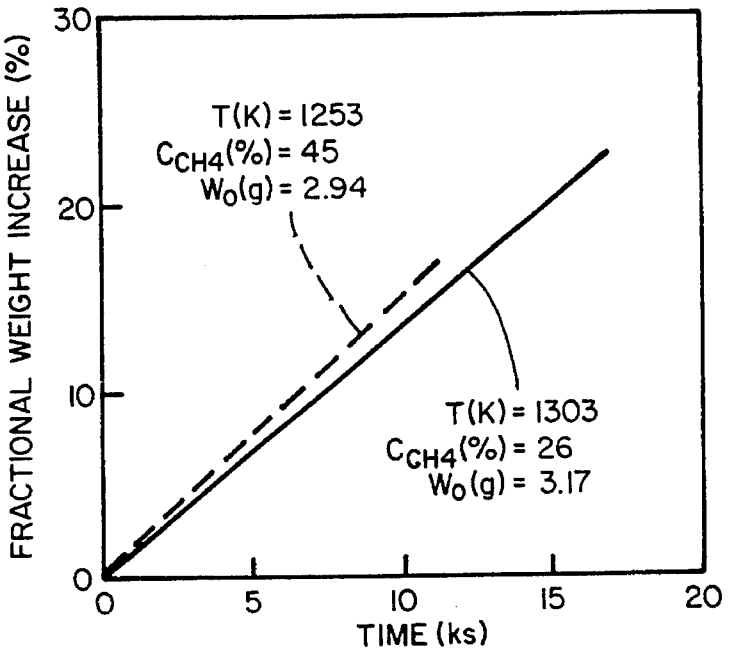
FIG. 3 shows the fractional weight increase of metallurgical coke due to infiltration as a function of time.

FIG. 3 shows the fractional weight increases of the coke. No weight increase was observed up to about 1223° K. and up to 20% methane. At these temperatures and concentrations, soot formation could not be avoided and it adhered to the surface of the sample. This soot was separated from the sample and weighed after each run. It amounted to approximately 50% of the weight increase for the 1303° K. run and 70% for the 1253° K. run. The weight increase shown in FIG. 3 includes that of the soot formed on the surface of sample.

Figure 4:
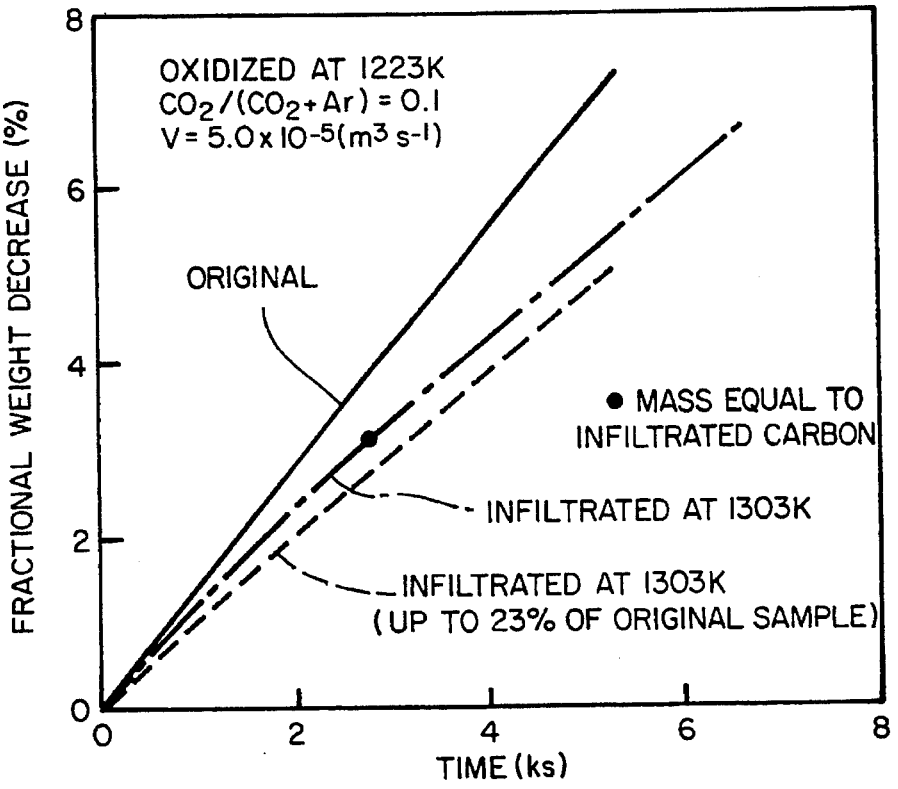
FIG. 4 shows the fractional weight decrease of metallurgical coke due to oxidation as a function of time.

The fractional weight decrease for coke during oxidation is shown in FIG. 4. The rate of the fractional weight decrease of the infiltrated coke was less than that for the original coke through the whole reaction. Additionally, it became less than the initial rate even beyond the point corresponding to the oxidation of the infiltrated carbon. The final rate was lower than that of original coke by one third; the rate for the original coke was $1.4\times10^{-3}o/os^{-1}$ and that for infiltrated coke was $9.2\times10^{-4}o/os^{-1}$.

Figure 5A:
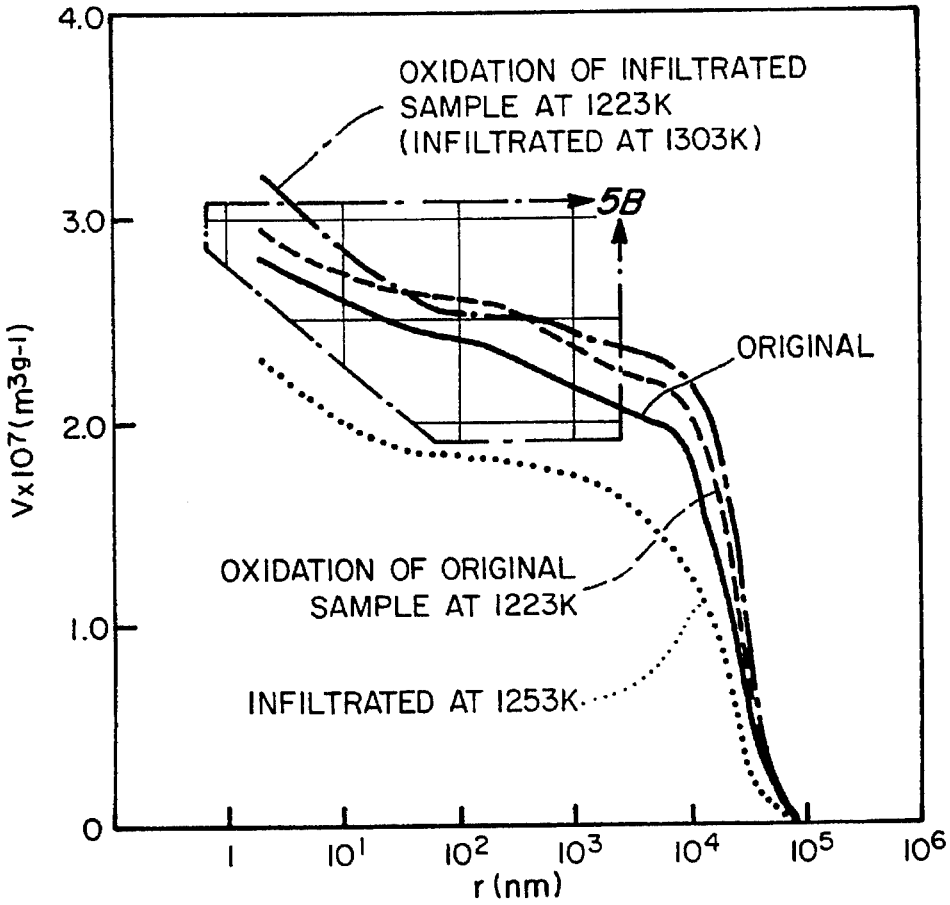
FIG. 5 shows the change of cumulative pore volume distribution of metallurgical coke due to infiltration and oxidation.
Figure 5B:
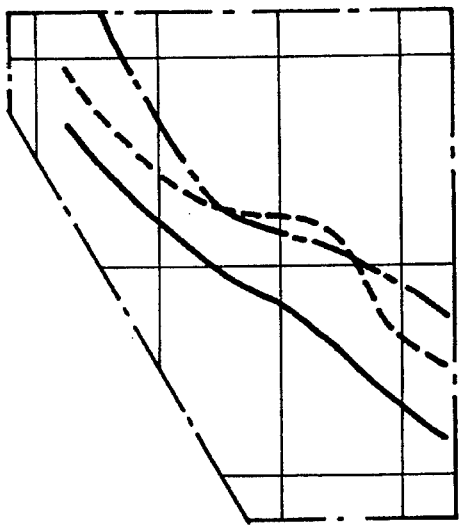

The cumulative pore size distributions for original, infiltrated and oxidized samples were measured with a mercury porosimeter and are shown in FIG. 5 for metallurgical coke. The pores in metallurgical coke are broadly distributed from larger pores (r>10 μm) to the smaller pores (2 nm<r<10 μm). They are separated by the "knee" on the penetration curve at about 10 μm.

The volume of large pores (r>10 μm) decreased or increased during infiltration or oxidation. However, during oxidation the pores in the range (30 nm<r<300 nm) disappeared as shown by the plateau in this range (magnified inset in FIG. 5), perhaps by coalescence of the pores in this range to form larger pores; the volume that has disappeared is about half of the increase in large pore volume. Therefore, oxidation is expected to occur mainly in these small pores.

As seen from the curve for infiltration, these pores may be filled with carbon. However, insufficient filling of pores (narrowing only the entrance of the pores and forming a bottle neck) might lead to an apparent increase of volume of very small pores (r<30 nm) as shown by the increase in the slope at the left end of the curve for infiltration. The remarkable result was that, as seen from comparison of the curves for oxidation of the infiltrated sample and infiltration, the small pores (r<1 μm) of the infiltrated sample did not increase their volume after oxidation; only the volume of large pores increased.

FIG. 6 is a schematic illustration of pore structure changes during infiltration of coke. The large pores (r>10 μm) and small pores (30 nm<r<1 μm) are drawn. Even smaller pores (r<30 nm) are not shown here because they have little role in the reaction under the present experimental conditions. It is seen that the coke has many small pores. The surface area which was measured by use of a mercury porosimeter is shown in FIG. 7. The cumulative surface area increases drastically with decreasing pore size, the area is expressed on a logarithmic scale.

Figure 6A:
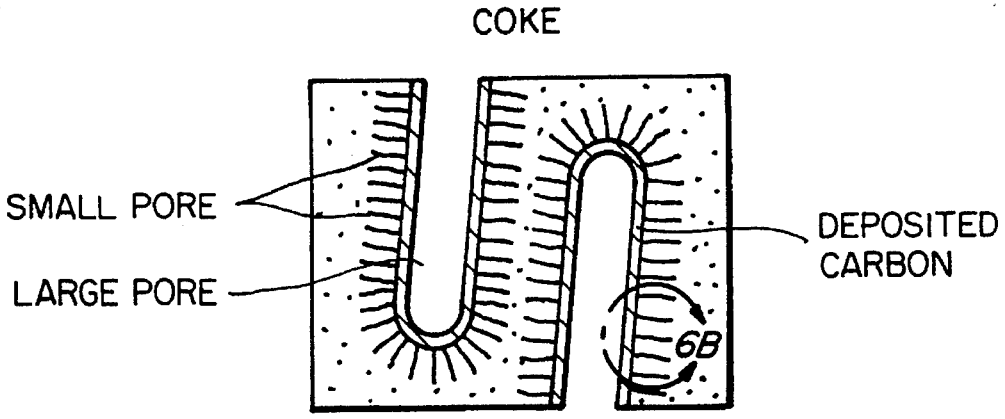
FIG. 6 is a schematic illustration of pore structure changes of coke during infiltration and oxidation following infiltration.
Figure 6B:
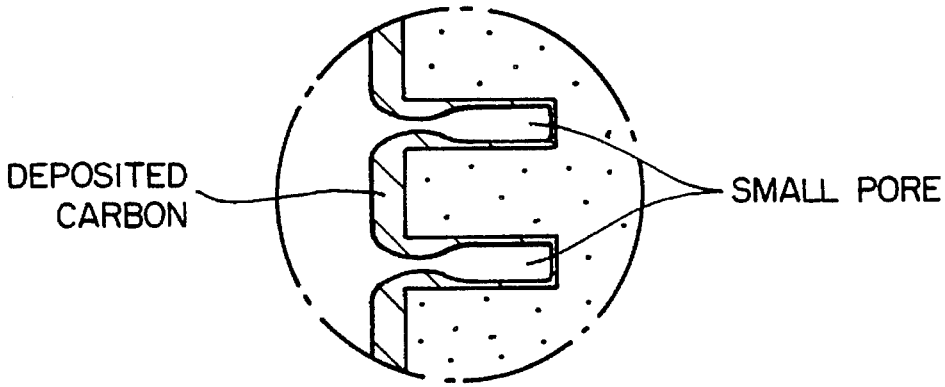
Figure 6C:
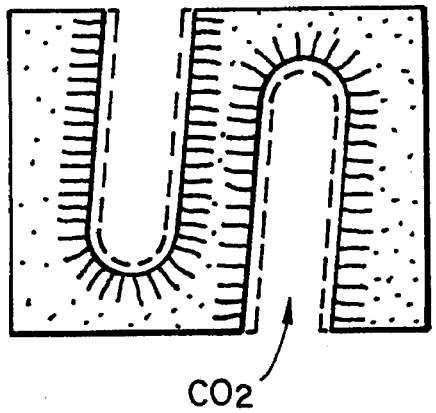
Figure 7A:
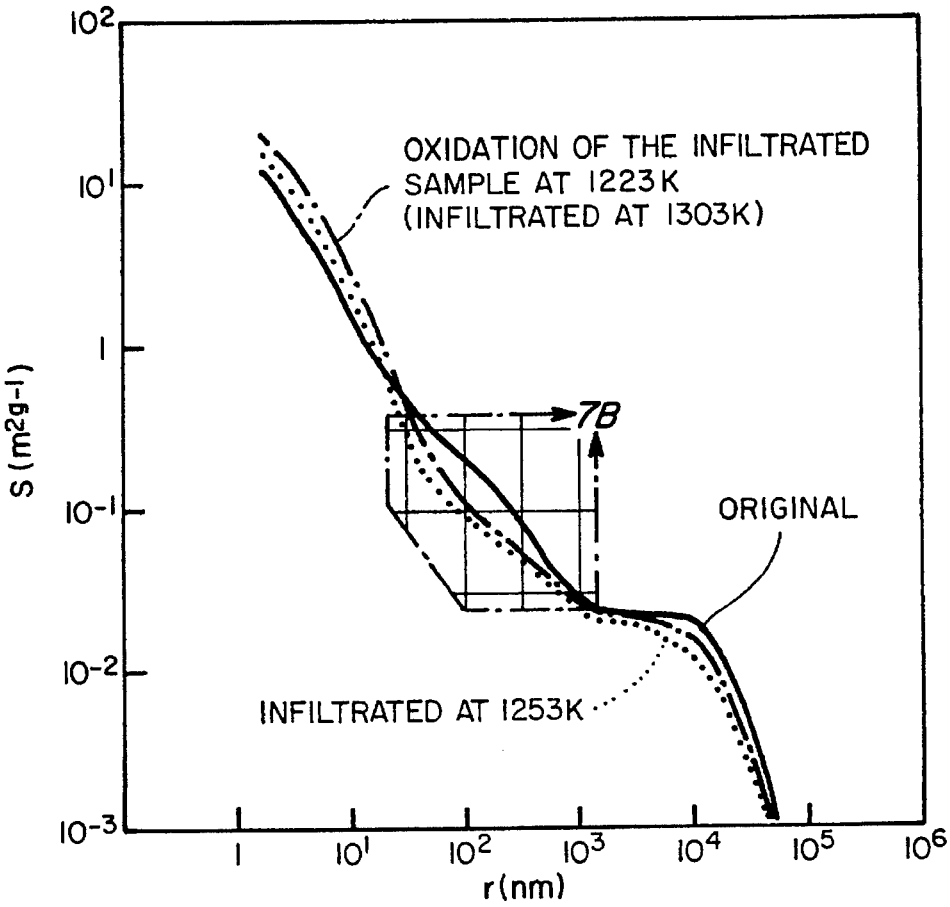
FIG. 7 shows the change of cumulative surface area distribution for metallurgical coke due to infiltration and oxidation.
Figure 7B:
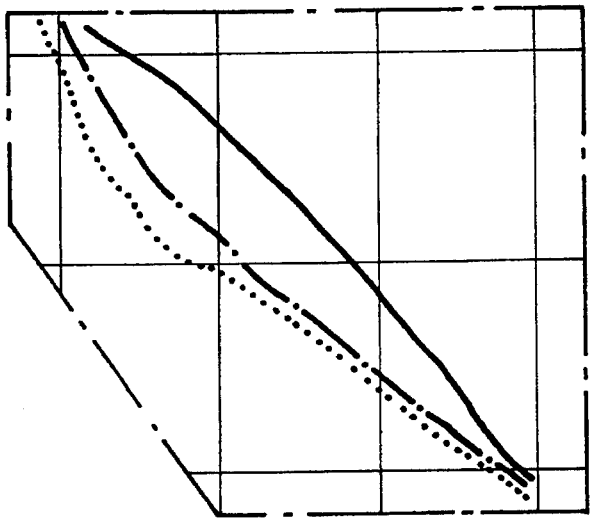

As for the infiltration, FIG. 6A, a layer of carbon of uniform thickness is expected to form in the large pores. The small pores in coke (30 nm<r<1 μm) are impregnated with carbon in the vicinity of pore entrance, forming a bottle neck, FIG. 6B. For the oxidation of coke as shown in FIG. 6C, the layer of deposited carbon in the large pore is readily oxidized. The infiltrated small pores can be saved from oxidation because plugging of their entrances makes it difficult for $CO_2$ to intrude into these pores. These small pores have greater surface area than that of larger pores and during infiltration, this surface area decreases more than that of the large pores. For instance, as shown in FIG. 7, the surface area of the small pores (80 nm<r<1 μm) decreases from 0.25 to 0.1 ($m^{2g-1}$) by infiltration but the large pores (r>1 μm) decrease from 0.02 to 0.013 ($m^{2g-1}$). This means the decrease is 20 times larger for the former pores. In the oxidation of these impregnated pores, the small pores increase little in their area while the large pores increase up to the original value. Therefore, the oxidation rate for the infiltrated sample is understandably smaller than that for the original coke, even after carbon deposited in the large pores disappears by oxidation.

In one example, two samples of coke were infiltrated with a mixture of 24% methane ($CH_4$) and 76% argon (Ar) at 1030° K. for a period of 6 hours. The weight increase was 4.1%. An uninfiltrated sample and the two infiltrated samples were tested for reactivity to $CO_2$ and strength after reaction and yielded the following results:

| | Reactivity Index CRI (%) | Strength after Reaction CSR (%) |
|---|---|---|
| Uninfiltrated sample | 31.7 | 54.0 |
| Infiltrated sample: | | |
| Number 1: | 18.3 | 75.8 |
| Number 2: | 17.5 | 78.5 |

This shows a remarkable upgrading of coke which was marginally suitable for metallurgical coke.

Our invention can be readily applied in the steel industry for upgrading cokes as they leave coke ovens.

Technology, known as coke-dry-quenching (CDQ), exists and is in use in the steel industry to avoid the difficulties (primarily environmental) associated with water quenching of coke as it leaves the coke ovens. It is believed that one way to apply the present invention for industrially upgrading cokes would be by modifying CDQ.

Figure 8:
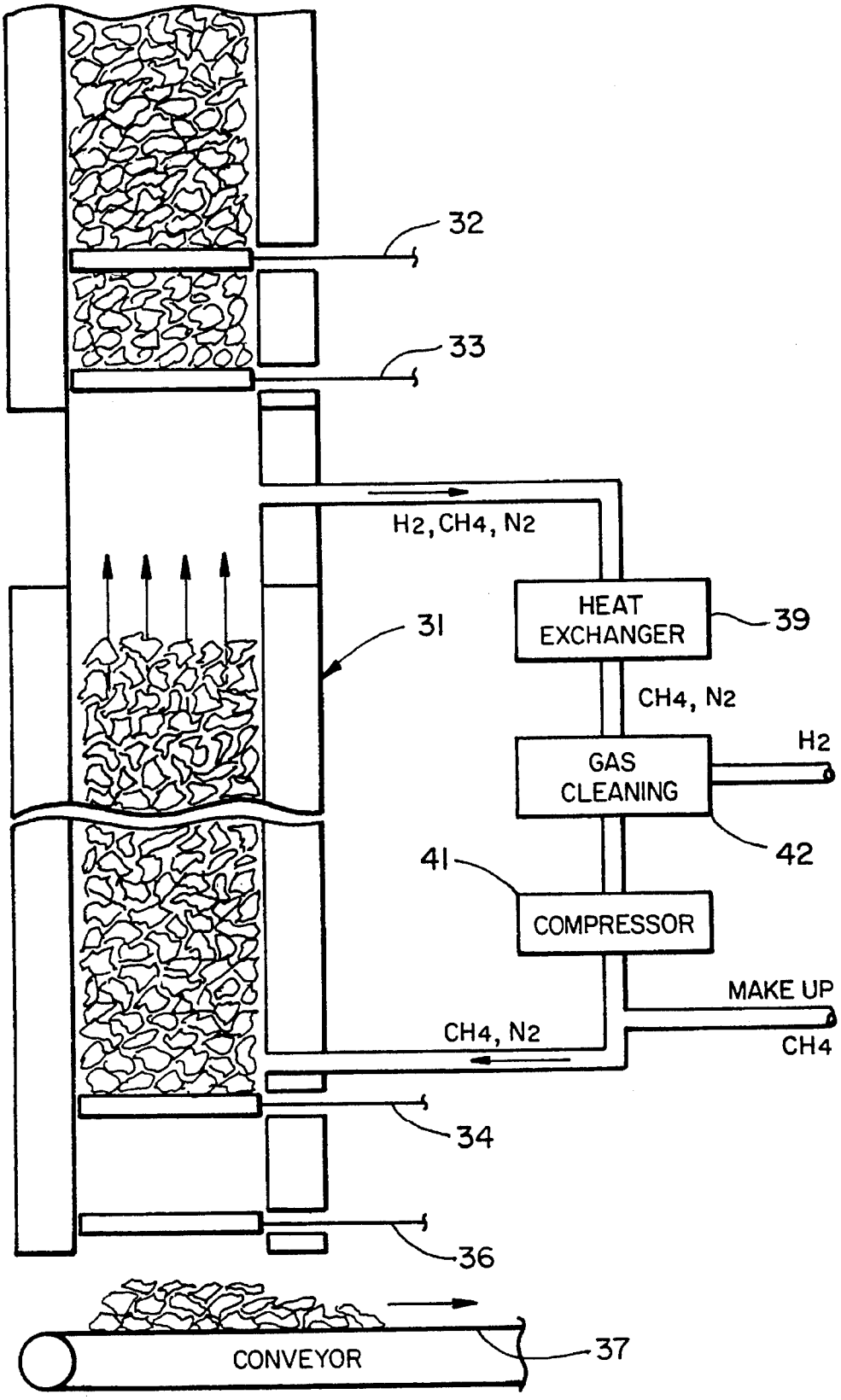
FIG. 8 is a schematic representation of the invention applied to a dry quenching chamber for cooling coke.

In CDQ hot coke from a coke oven is passed downward through a chamber such as chamber 31, FIG. 8, through which an upflow of cooler inert gas (typically nitrogen) is passed. The coke in the chamber is in the form of a downward moving packed bed with fresh hot coke falling on the top and cooler coke removed from the bottom. The coke is fed into the chamber 31 from a coke oven by means of gates 32 and 33. With gate 32 closed, gate 33 is opened to allow a charge of coke to fall into the chamber 31. Simultaneously, gate 34 at the bottom of the chamber is opened to allow cooled coke to fall into the gate 36. The gate 34 is then closed and gate 36 opened to allow the cooled coke to drop onto a conveyor 37. This latter coke is sufficiently cool that it will not ignite on exposure to air. The nitrogen introduced at the bottom of the bed heats up as it passes upwards and leaves the chamber at the top with a temperature close to that of the entering coke. This high temperature nitrogen stream is cooled by passing it through a heat exchanger 39 and it is then passed back into the bottom of the coke quench chamber by means of a compressor 41. A gas cleaning system 42 may be incorporated in order to remove fine coke particles, etc., from the nitrogen stream ahead of the compressor (or ahead of the heat exchanger).

In accordance with the present invention, CDQ can be modified to enable simultaneous coke cooling and upgrading in the quench chamber. This is accomplished by replacing the nitrogen stream by a mixture of methane and inert gas (which might also be nitrogen). As described above, the methane will thermally decompose in the pores of the hot coke in a way that makes the coke less susceptible to degrading by oxidation within the blast furnace (or other metallurgical reactors). Hydrogen is generated by this decomposition reaction and the gas stream leaving the modified CDQ quench reactor will consist of hydrogen, inert gas and unreacted methane. Hydrogen is relatively easily removed from the exit gas stream (e.g., by membrane diffusion) and such removal need not be complete. Following hydrogen removal, "make-up" methane is introduced into the gas stream and it is recycled to the quench chamber by a compressor. The coke enters the chamber 31 at relatively high temperature and will supply the heat necessary for the thermal decomposition of the methane. The methane is a byproduct of the coke oven. Thus, it is expected that the entire process can be carried out without additional costs for hydrocarbon or for heating.

What is claimed:

1. The method of treating coke having large pores with radii greater than 10 μm and small pores with radii less than 10 μm throughout the coke after it is processed to improve its oxidation resistance characteristics which comprises the steps of:

infiltrating substantially all the pores of the coke with a hydrocarbon gas, and cracking the hydrocarbon to form a carbon deposit on the surface of substantially all of the pores, said deposit coating substantially all of the pores and substantially closing the entrance to the small pores, thereby decreasing the surface area of the small pores as compared to the large pores to thereby reduce the oxidation rate of the coke.

2. The method of treating coke as in claim 1 in which the smaller pores have a radius in the range of about 30 nm to 0.3 μm.

3. The method of treating coke as in claim 1 in which the hydrocarbon cracking is carried out in the range of temperature 973° K. to 1373° K.

4. The method of treating coke as in claim 1 in which the hydrocarbon cracking is carried out in the temperature range of 1073° K. to 1173° K. for a period of one to three hours.

5. The method as in claims 1, 2, 3 or 4 in which the hydrocarbon is methane.

6. The method as in claims 1, 2, 3 or 4 in which the hydrocarbon is selected from the group consisting of methane, natural gas, propane, butane, benzene or acetylene.

7. The product resulting from the method of claims 1, 2, 3 or 4.

8. Coke having large pores throughout the coke with radii greater than 10 μm and small pores with radii less than 10 μm characterized by having all of its pores coated with a layer of carbon to a thickness such that the smaller pores are substantially closed, thereby substantially decreasing the surface area of the small pores as compared to the large pores to make the coke resistant to oxidation.

9. Coke as in claim 8 in which the smaller pores are in the size range of 30 nm to 0.3 μm.

10. The method as in claims 1, 2, 3 or 4 in which the method is applied by modification of coke-dry-quencing technology.

* * * * *